US007969362B2

(12) United States Patent
Huang et al.

(10) Patent No.: US 7,969,362 B2
(45) Date of Patent: Jun. 28, 2011

(54) SUPER WIDE BANDWIDTH COUPLING ANTENNA

(75) Inventors: Ching-Hsiung Huang, Taipei (TW); Ming-Han Perng, Taipei (TW); Heng-Chia Liao, Taipei (TW)

(73) Assignee: Joinsoon Electronic Manufacturing Co., Ltd., Taipei County (TW)

( * ) Notice: Subject to any disclaimer, the term of this patent is extended or adjusted under 35 U.S.C. 154(b) by 350 days.

(21) Appl. No.: 11/872,039

(22) Filed: Oct. 15, 2007

(65) Prior Publication Data

US 2009/0096675 A1 Apr. 16, 2009

(51) Int. Cl.
*H01Q 1/38* (2006.01)

(52) U.S. Cl. ..... 343/700 MS; 343/702; 343/745

(58) Field of Classification Search ..... 343/700 MS, 343/702, 841, 846, 878, 745
See application file for complete search history.

(56) References Cited

U.S. PATENT DOCUMENTS 4,922,260 A * 5/1990 Gaskill et al. ..... 343/718
7,397,430 B2 * 7/2008 Harihara ..... 343/700 MS
7,446,717 B2 * 11/2008 Hung et al. ..... 343/702
7,557,759 B2 * 7/2009 Lin et al. ..... 343/702
2008/0291091 A1 * 11/2008 Su et al. ..... 343/700 MS

* cited by examiner

*Primary Examiner* — Jacob Y Choi
*Assistant Examiner* — Kyana R Robinson
(74) *Attorney, Agent, or Firm* — Leong C. Lei

(57) ABSTRACT

A super wide bandwidth coupling antenna comprises a first radiation portion made of electric conductor; the first radiation having a body and a feeding frame extending from a body of the first radiation portion; a second radiation portion formed by an electric conductor; a supporting frame extending from a body of the second radiation portion; a ground portion made of electric conductor; one end of the ground portion being connected to the supporting frame of the second radiation portion; a signal feeding wire having a main signal end wire which is electrically connected to the feeding frame of the first radiation portion; a ground end wire of the signal feeding wire being electrically connected to the ground portion; an isolation post for positioning the first radiation portion and second radiation portion with an insulating gap between the first radiation portion and second radiation portion.

3 Claims, 9 Drawing Sheets

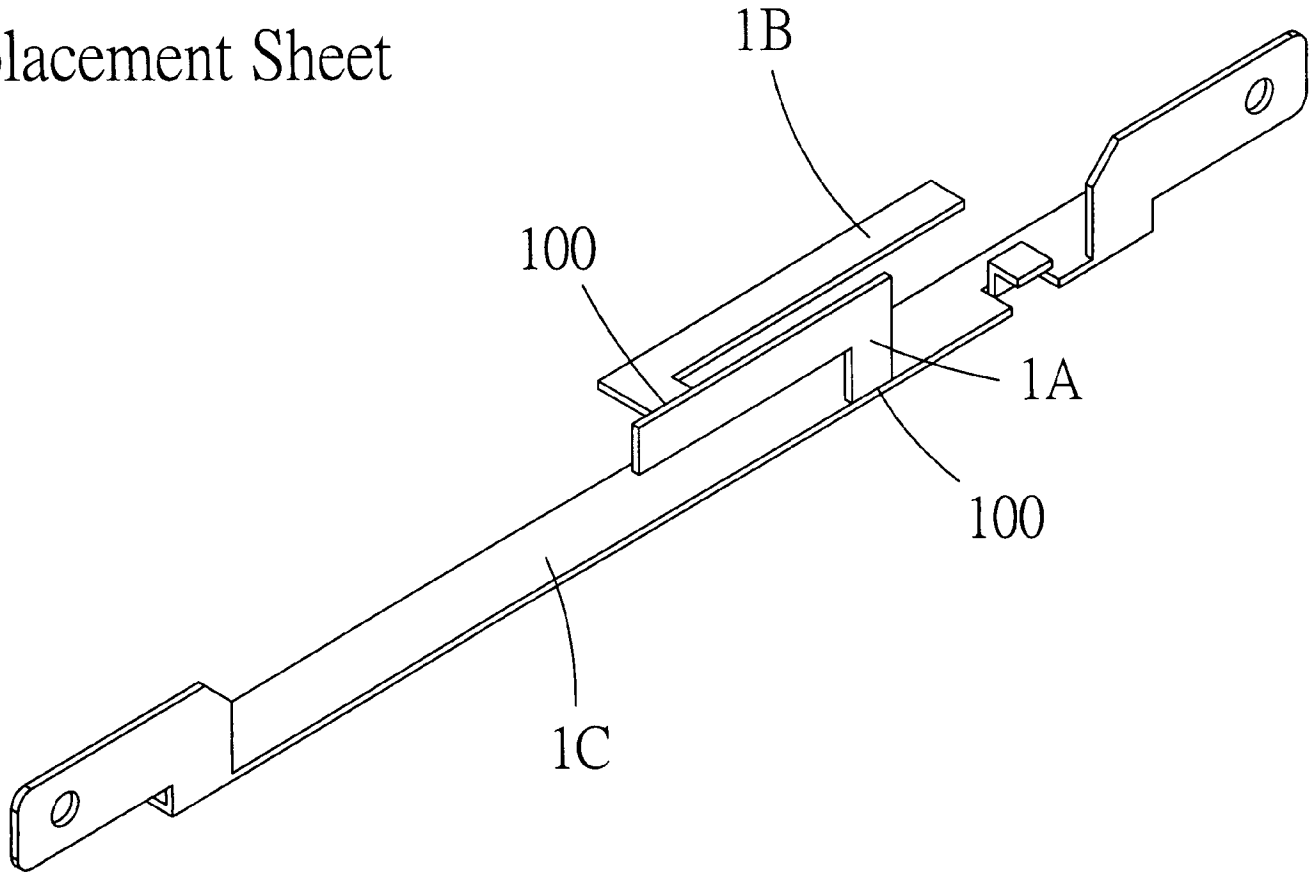
Fig. 1(PRIOR ART)
Replacement Sheet

SUPER WIDE BANDWIDTH COUPLING ANTENNA

FIELD OF THE INVENTION

The present invention relates to antennas, and particularly to a super wide bandwidth coupling antenna, wherein an isolation post serves for positioning the first radiation portion and second radiation portion with an insulating gap between the first radiation portion and second radiation portion. The gap has a coupling effect so as to achieve an optimum frequency response.

BACKGROUND OF THE INVENTION

There are four standards for the wireless local network, which are IEEE802.11, IEEE802.11b and Bluetooth suitable for 2.4 GHz, and IEEE802.11a suitable for 5 GHz. If a wireless electronic device is used for various standards with different wireless frequency bands, a wide band antenna is necessary.

In one prior art for dual frequency antenna, an F type antenna is used for receiving signals from a first frequency and a second frequency. The antenna has a first plane conduction element and a second plane conduction element. The first plane conduction element is an L type structure and the second plane conduction element has a rectangular structure and is connected to and vertically to the first plane conduction element at a joint. The antenna is formed as a dipole antenna, in that the bandwidth, impedance matching and gain are adjusted by the shape of the first plane conduction element and second plane conduction element. However the area of the second plane conduction element will affect the gain of the antenna. If an antenna with higher gain is necessary, the area of a substrate thereof must be enlarged, but this is confined by the device space. Thus the area of the substrate can not be enlarged as desired.

Referring to FIG. 1, a schematic view about the super wide bandwidth antenna of the present invention. In that the prior art super wide bandwidth antenna has a first radiation portion 1A, a second radiation portion 1B and a ground portion 1C. Slits 100 are formed between the first radiation portion 1A and the second radiation portion 1B and between the second radiation portion 1B and the ground portion 1C. Although this kind of antenna can achieve the requirement of super wide bandwidth, it is illustrated that the electric properties are not stable. This can be got from the return lose. That, the area between the 3.5 GHz~3.8 GHz has a return lose near −12 dB. It is easy to be bent or break as it is installed to an electronic device.

SUMMARY OF THE INVENTION

Accordingly, the primary object of the present invention is to provide a super wide bandwidth coupling antenna, wherein an isolation post serves for positioning the first radiation portion and second radiation portion with an insulating gap between the first radiation portion and second radiation portion. The gap has a coupling effect so as to achieve an optimum frequency response in the induction of the super wide bandwidth coupling antenna of the present invention.

Another object of the present invention is that in the super wide bandwidth coupling antenna, the first radiation portion, second radiation portion and ground portion are adhered to the surfaces of the isolation post by electroplating or electric coating.

A further object of the present invention is that in the super wide bandwidth coupling antenna, the first radiation portion, the second radiation portion and the ground portion are firstly retained to a rubber film and then are adhered to the isolation post.

A yet object of the present invention is that the first radiation portion, second radiation portion and ground portion are flushed with surfaces of the isolation post.

To achieve above objects, the present invention provides a super wide bandwidth coupling antenna, comprising: a first radiation portion made of electric conductor; the first radiation having a body and a feeding frame extending from a body of the first radiation portion; the body being formed with at least one positioning groove; a second radiation portion formed by an electric conductor; a supporting frame extending from a body of the second radiation portion; the second radiation portion being formed with at least one positioning groove; a ground portion made of electric conductor; one end of the ground portion being connected to the supporting frame of the second radiation portion; the ground portion being formed with at least one positioning groove; the ground portion 4 has the same potential to an antenna receiver; a signal feeding wire having a main signal end wire which is electrically connected to the feeding frame of the first radiation portion; a ground end wire of the signal feeding wire being electrically connected to the ground portion; an isolation post for positioning the first radiation portion and second radiation portion with an insulating gap between the first radiation portion and second radiation portion; the gap having a coupling effect so as to achieve an optimum frequency response in the induction of the super wide bandwidth coupling antenna; a surface of the isolation post having a plurality of positioning ribs for engaging with the positioning groove of the first radiation portion, the positioning groove of the second radiation portion and the positioning groove of the ground portion so as to retain the first radiation portion, the second radiation portion and the ground portion to the isolation post; the isolation post having the effects of avoiding the noise interference and the decay from impedance matching between the first radiation portion, the second radiation portion and the ground portion; and the isolation post has a guide groove for guiding the signal feeding wire.

The various objects and advantages of the present invention will be more readily understood from the following detailed description when read in conjunction with the appended drawing.

BRIEF DESCRIPTION OF THE DRAWINGS

FIG. 1 is a perspective view of the prior art antenna.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 2:
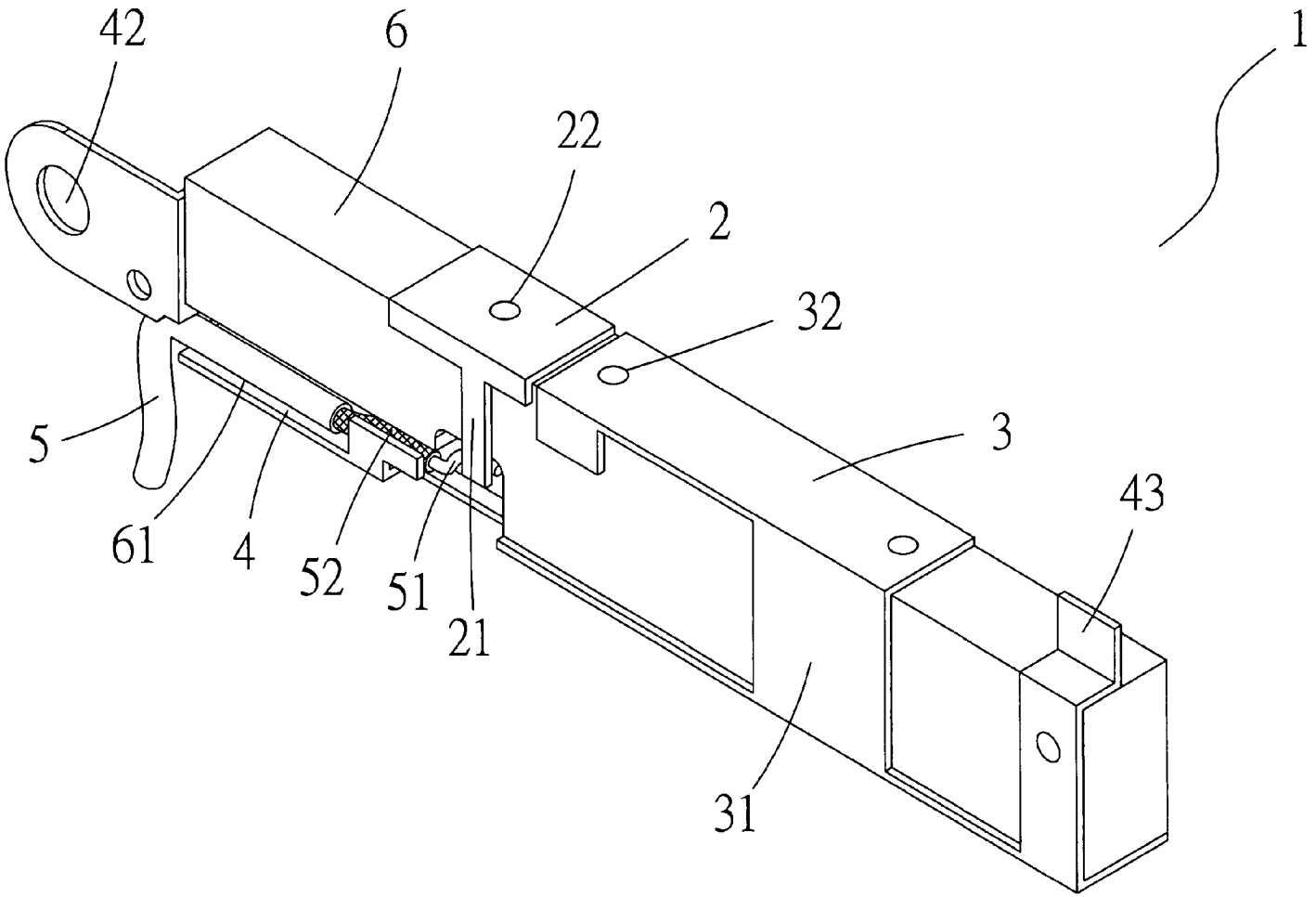
FIG. 2 is a schematic view about the super wide bandwidth coupling antenna of the present invention.
Figure 3:
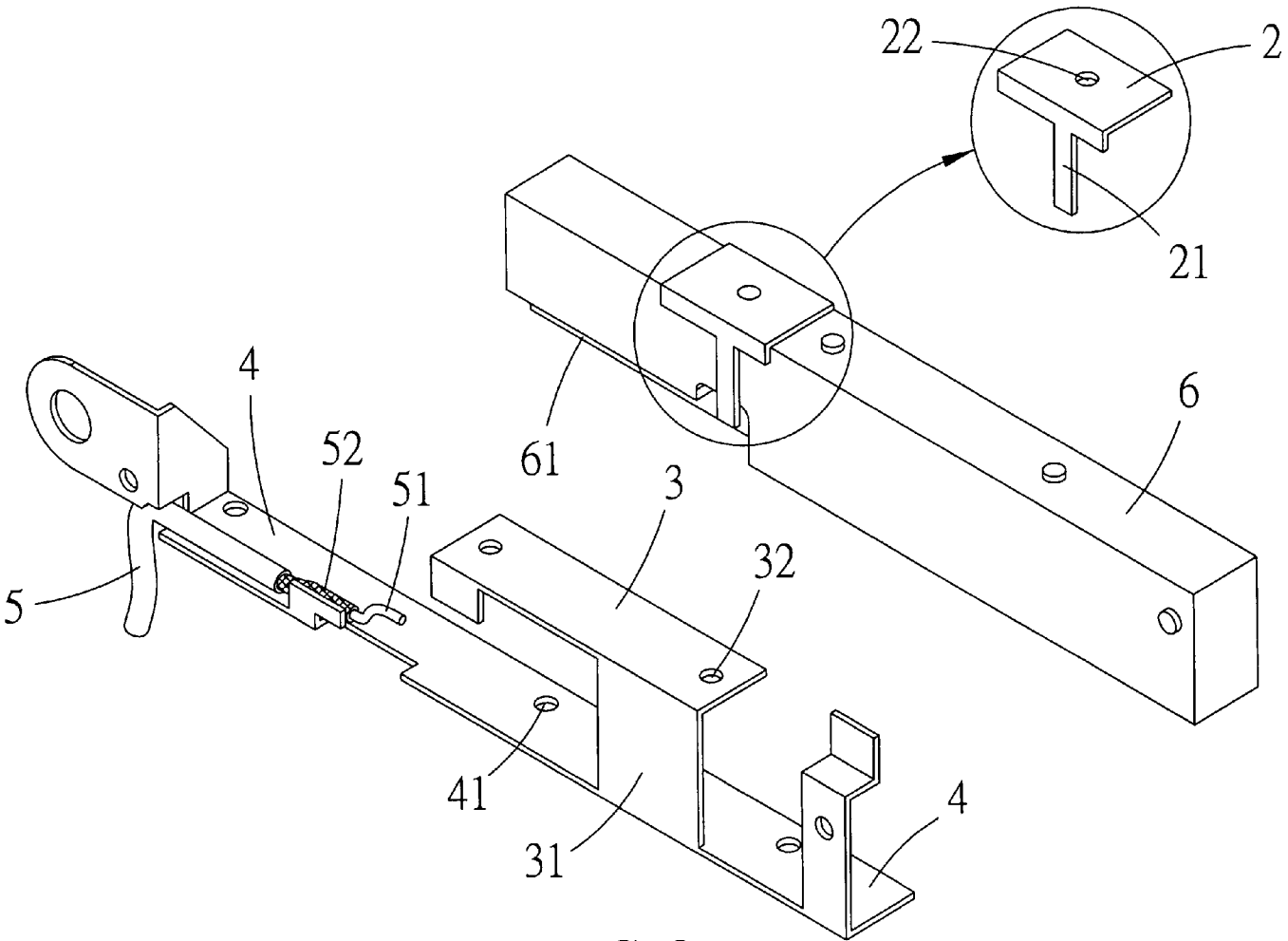
FIG. 3 is an explosive schematic view of the super wide bandwidth coupling antenna of the present invention.

Referring to FIGS. 2 and 3, the super wide bandwidth coupling antenna of the present invention is illustrated. The antenna of the present invention includes the following elements.

A first radiation portion 2 is made of electric conductor. The first radiation portion 2 has a body and a feeding frame 21 approximately vertical to the body of the first radiation portion 2. The body is formed with at least one positioning groove 22.

A second radiation portion 3 is formed by an electric conductor. A supporting frame 31 is approximately vertically extended from a body of the second radiation portion 3. The second radiation portion 3 is formed with at least one positioning groove 32.

A ground portion 4 is made of electric conductor. One end of the ground portion 4 is connected to the supporting frame 31 of the second radiation portion 3. The ground portion 4 is formed with at least one positioning groove 41. The ground portion 4 has the same potential to an antenna receiver.

A signal feeding wire 5 has a main signal end wire 51 which is electrically connected to the feeding frame 21 of the first radiation portion 2. A ground end wire 52 of the signal feeding wire 5 is electrically connected to the ground portion 4.

An isolation post 6 serves for positioning the first radiation portion 2 and second radiation portion 3 with an insulating gap between the first radiation portion 2 and second radiation portion 3. The gap has a coupling effect so as to achieve an optimum frequency response in the induction of the super wide bandwidth coupling antenna 1 of the present invention. A surface of the isolation post 6 has a plurality of positioning ribs for engaging with the positioning groove 22 of the first radiation portion 2, the positioning groove 32 of the second radiation portion 3 and the positioning groove 41 of the ground portion 4 so as to retain the first radiation portion 2, second radiation portion 3 and ground portion 4 to the isolation post 6. Preferably, the isolation post 6 is an isolation rubber post. The isolation post 6 has the effects of avoiding the noise interference and the decay from impedance matching between the first radiation portion 2, the second radiation portion 3 and the ground portion 4. The isolation post 6 has a guide groove 61 for guiding the signal feeding wire 5.

Figure 4:
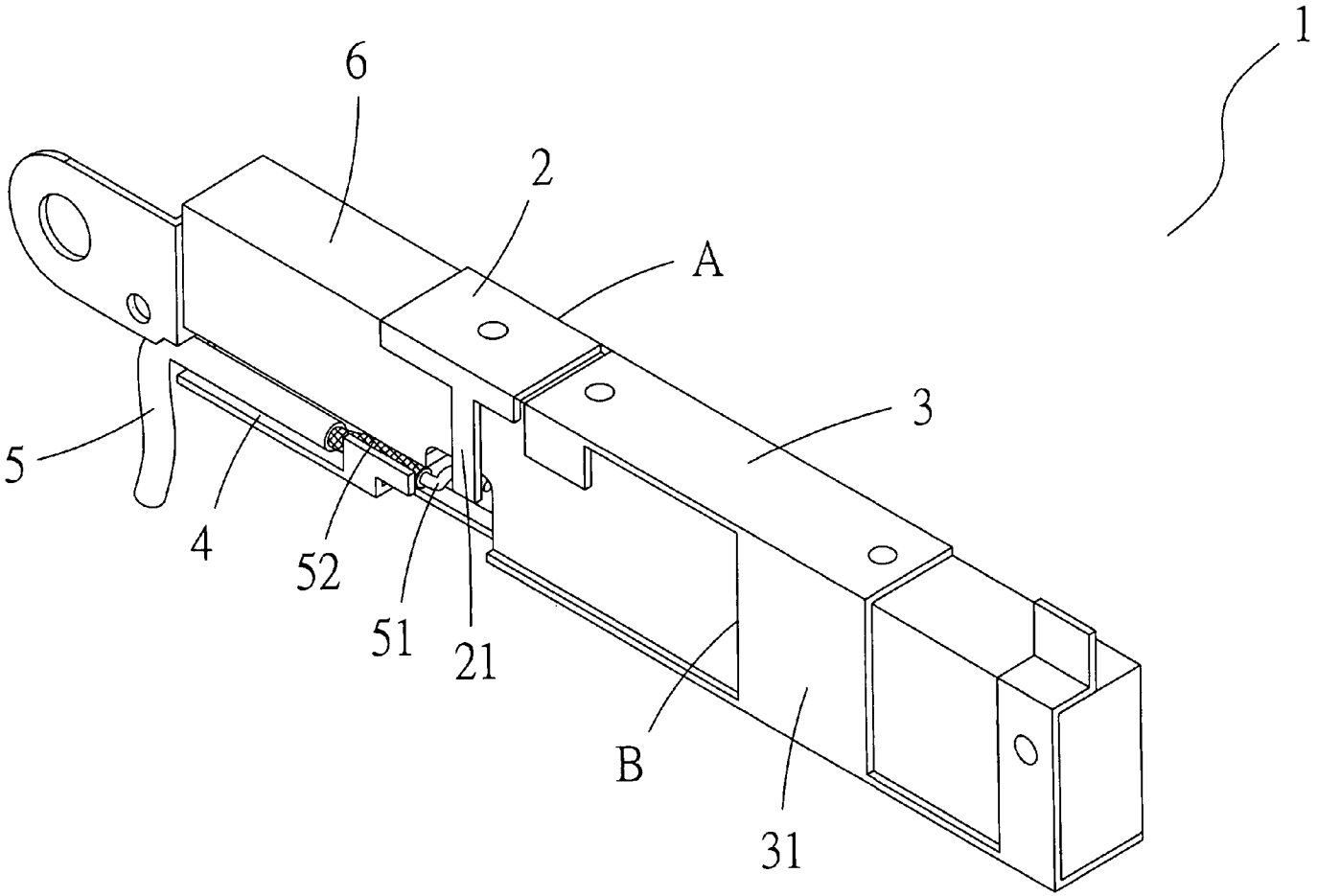
FIG. 4 is a schematic view showing the radiation path of the present invention.

Thus, by above mentioned structure, in the present invention, by adjusting the first radiation portion 2, second radiation portion 3, ground portion 4 and the isolation post 6 to have the effect of impedance matching, the bandwidth of the antenna 1 can be increased. Furthermore, by the signal feeding wire 5 installed at the ground portion 4 and the feeding frame 21 of the first radiation portion 2, the signals feeding from the signal feeding wire 5 have reduced reflection energy. Thereby signals can be transferred to the first radiation portion 2 and second radiation portion 3 completely. The impedance matching of the antenna has an optimum effect. The radiation path will affect the completeness of the radiation pattern. Referring to FIG. 4, the schematic view of the radiation path of the present invention is illustrated. In the drawing, the areas encircled by the width and slender dashed lines A, B represent the radiation paths of a first induction optimum frequency response and the second induction optimum frequency response. The isolation post 6 serves to adjust the gap between the first radiation portion 2 and second radiation portion 3. Thus, after the signals fed into the signal feeding wire 5, the output signals from the first radiation portion 2 and second radiation portion 3 have the same phases. Thereby the antenna has high gain.

Figure 5:
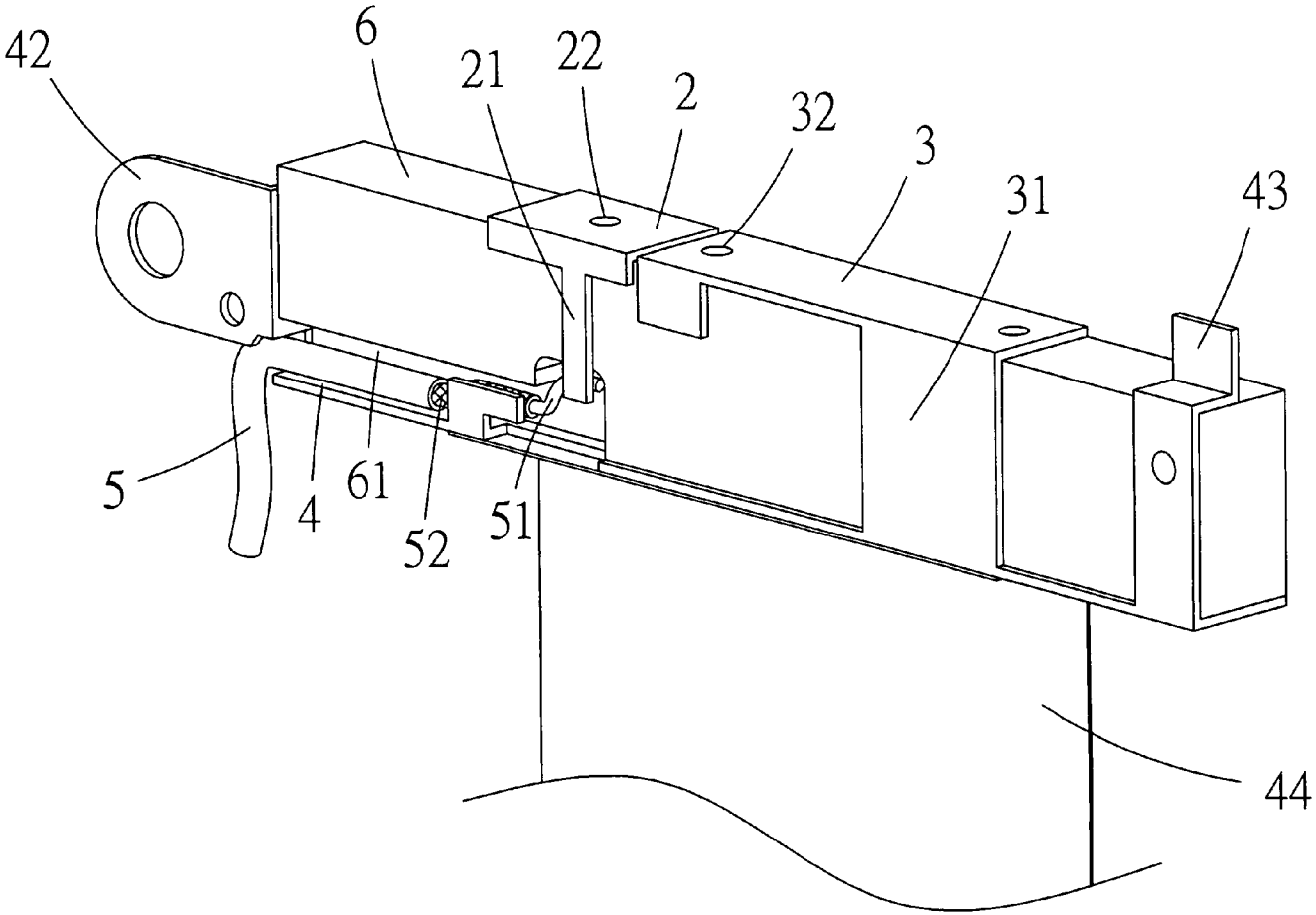
FIG. 5 is a schematic view about the ground portion of the present invention.
Figure 6:
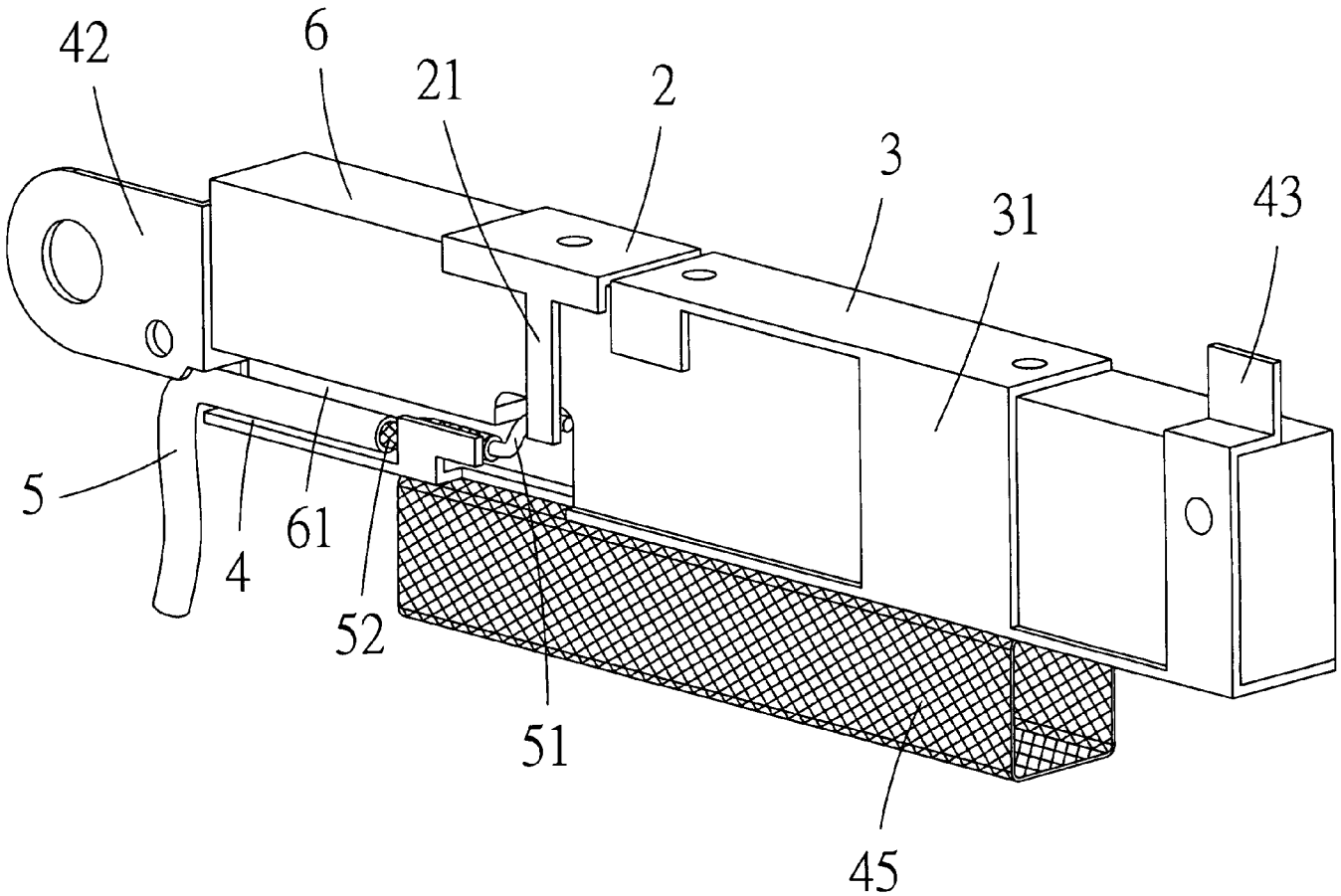
FIG. 6 is another view about the ground portion of the present invention.

Referring to FIGS. 5 and 6, it is illustrated that the ground portion 4 is installed with a fixing hole 42 or a fixing ear 43 for fixing the antenna of the present invention. Furthermore, the ground portion 4 is further connected to a plane 44 or a net unit 45 so as to cancel noises.

Figure 7:
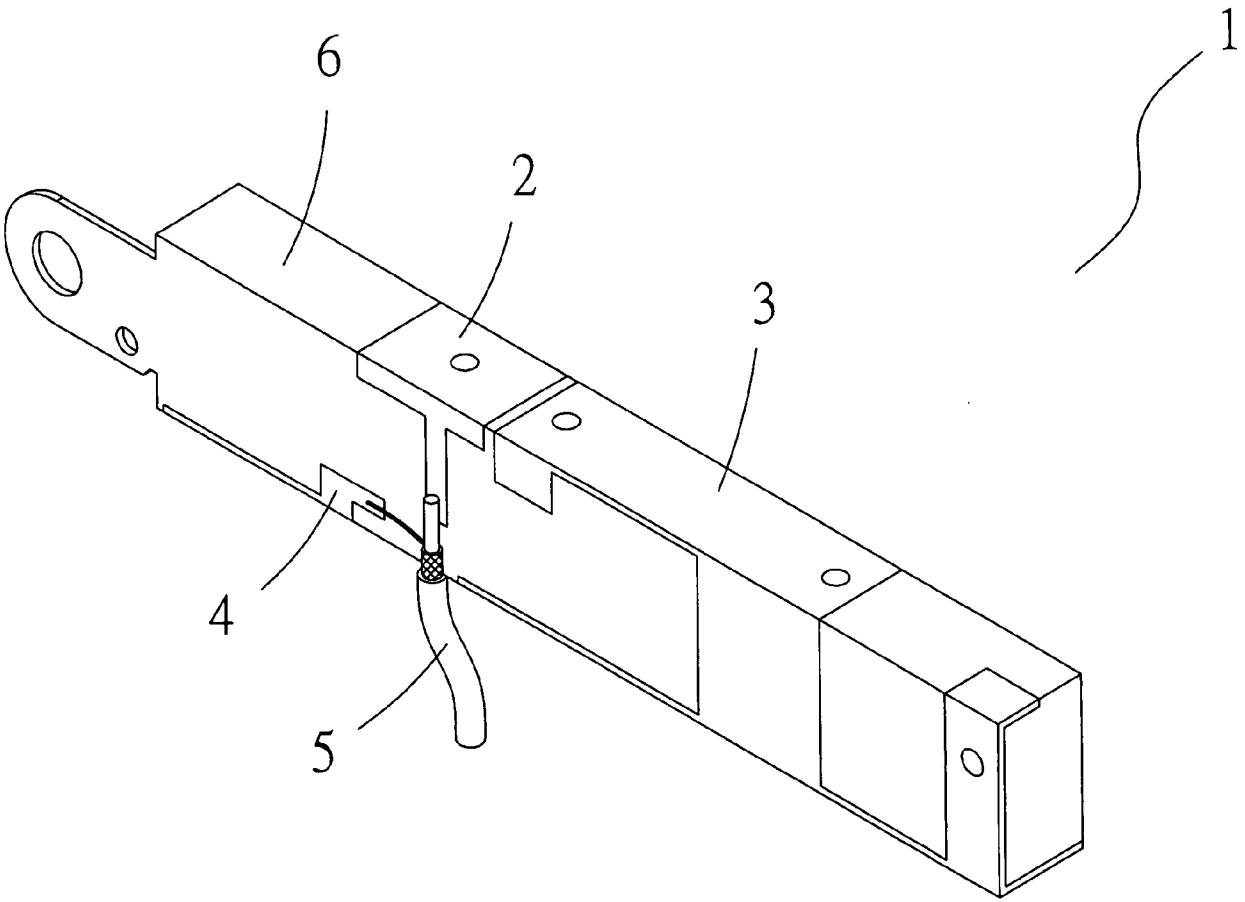
FIG. 7 is a schematic view about the super wide bandwidth coupling antenna of the present invention.
Figure 8:
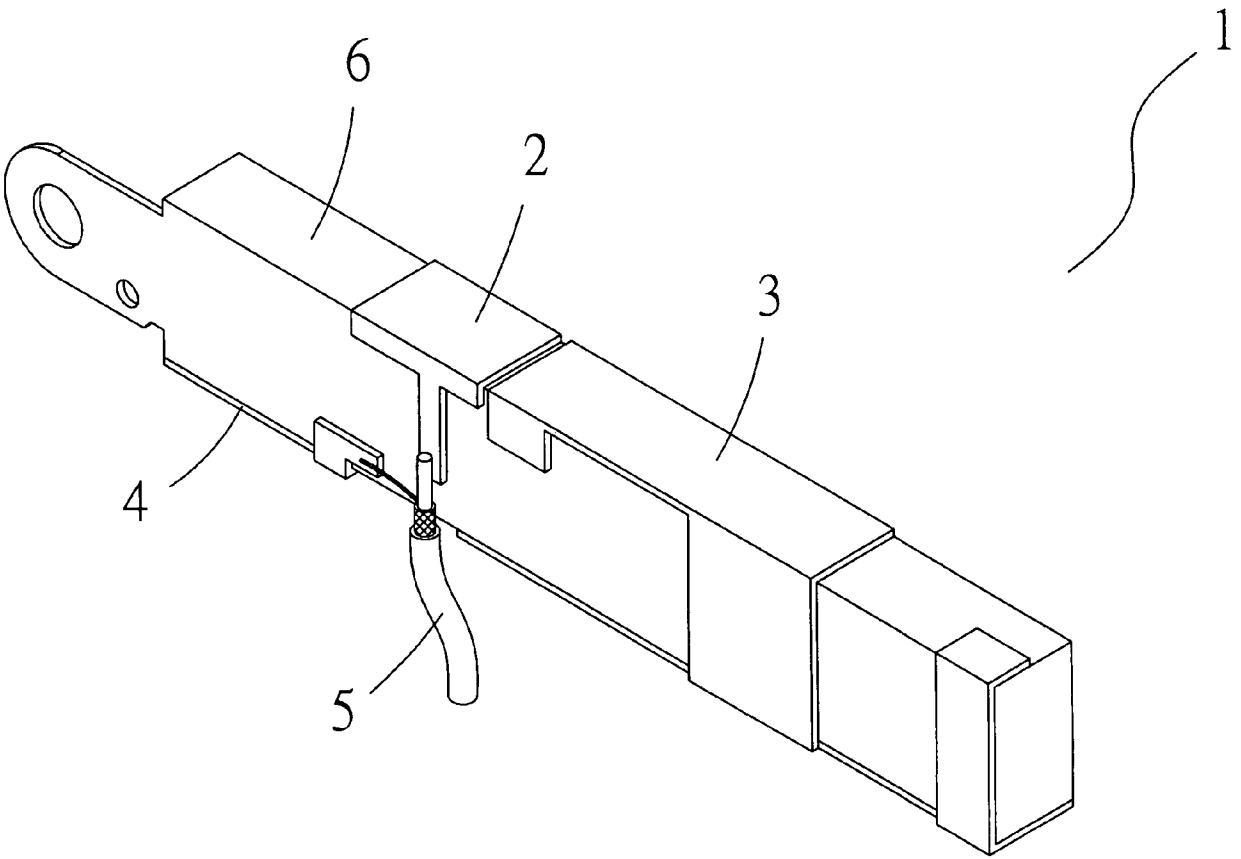
FIG. 8 is another schematic view about the antenna of the present invention.
Figure 9:
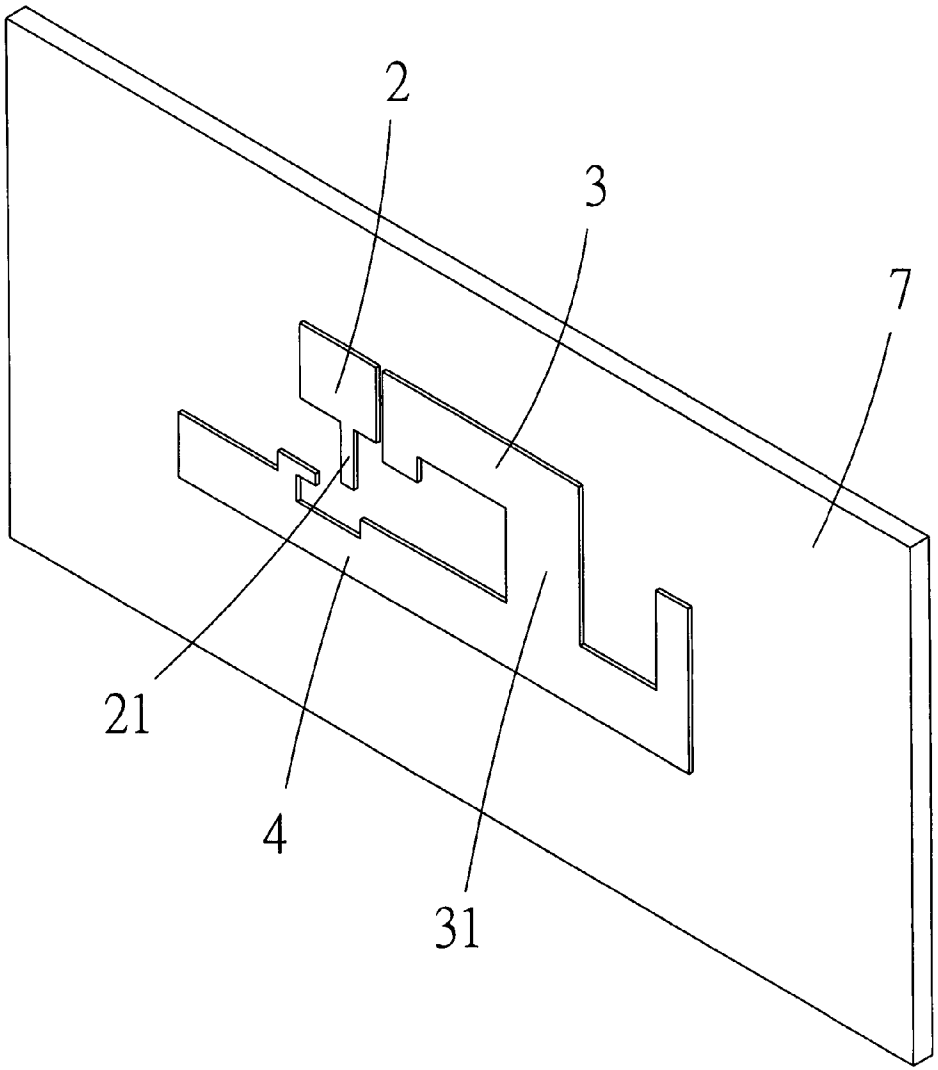
FIG. 9 is a further schematic view about the antenna of the present invention.

Referring to FIGS. 7, 8 and 9, it is illustrated that the first radiation portion 2, second radiation portion 3 and ground portion 4 are flushed with surfaces of the isolation post 6.

Furthermore, in the present invention, the first radiation portion 2, second radiation portion 3 and ground portion 4 of the present invention can be adhered to the surfaces of the isolation post 6 by electroplating or electric coating.

Moreover, in the present invention, the first radiation portion 2, the second radiation portion 3 and the ground portion 4 are firstly retained to a rubber film and then are adhered to the isolation post 6.

Advantages of the present invention are that the present invention has preferred bandwidth and gain. Furthermore, the present invention has lower profile and is light. Further the present invention has a compact size and is suitable for various electronic communication devices.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A super wide bandwidth coupling antenna comprising:

a first radiation portion made of electric conductor, the first radiation portion having a rectangular body and a T shape feeding frame extending vertically to a lateral side of the a body of the first radiation portion; the body being formed with at least one positioning groove on the rectangular body;

a second radiation portion formed by an electric conductor and having a rectangular body, a supporting frame extending vertically to a body of the second radiation portion, the second radiation portion being formed with at least one positioning groove on the rectangular body;

a ground portion made of electric conductor, one end of the ground portion being connected to the supporting frame of the second radiation portion, the ground portion being formed with at least one positioning groove, the ground portion having the same potential to an antenna receiver, the ground portion being electrically connected to a plane or a net unit for canceling noises, the ground portion being formed with a retaining hole;

a signal feeding wire having a main signal end wire which is electrically connected to the feeding frame of the first radiation portion, a ground end wire of the signal feeding wire being electrically connected to the ground portion; and an isolation post for positioning the first radiation portion and second radiation portion with an insulating gap between the first radiation portion and second radiation portion, the gap having a coupling effect so as to achieve an optimum frequency response in induction of the super wide bandwidth coupling antenna, a surface of the isolation post having a plurality of positioning ribs for engaging with the positioning groove of the first radiation portion, the positioning groove of the second radiation portion and the positioning groove of the ground portion so as to retain the first radiation portion, the second radiation portion and the ground portion to the isolation post, the isolation post having effects of avoiding noise interference and decay from impedance matching between the first radiation portion, the second radiation portion and the ground portion, and the isolation post having a guide groove for guiding the signal feeding wire;

the first radiation portion, the second radiation portion and the ground portion being firstly retained to a rubber film and then adhered to the isolation post;

the rectangular body of the first radiation portion and the body of the second radiation portion being positioned at an upper surface of the isolation post, the T shape feeding frame of the first radiation portion and the supporting frame of the second radiation portion being positioned on a lateral surface of the isolation post, and the ground portion being adhered to a lower surface of the isolation post;

wherein by adjusting the first radiation portion, the second radiation portion, the ground portion and the isolation post to have effect of impedance matching, bandwidth of the antenna can be increased; by the signal feeding wire installed at the ground portion, and the feeding frame of the first radiation portion, signals feeding from the signal feeding wire have reduced reflection energy thereby enabling signals to be transferred to the first radiation portion and the second radiation portion; and after signals fed into the signal feeding wire, output signals from the first radiation portion and the second radiation portion have same phases thus enabling the antenna to have high gain.

2. The super wide bandwidth coupling antenna as claimed in claim 1, wherein the isolation post is an isolation rubber post.

3. The super wide bandwidth coupling antenna as claimed in claim 1, wherein the first radiation portion, the second radiation portion and the ground portion are flushed with surfaces of the isolation post.

* * * * *